United States Patent [19]

Mosell

[11] 4,374,443

[45] Feb. 22, 1983

[54] CLEANING MACHINE WITH PARTICULATE ABRASIVE

[76] Inventor: Carl G. C. Mosell, Casa Spalato No. 2, Sitio de Calahonda, Mijas Costa, Malaga, Spain

[21] Appl. No.: 220,071

[22] PCT Filed: Apr. 1, 1980

[86] PCT No.: PCT/SE80/00094

§ 371 Date: Dec. 2, 1980

§ 102(e) Date: Dec. 2, 1980

[87] PCT Pub. No.: WO80/02105

PCT Pub. Date: Oct. 16, 1980

[30] Foreign Application Priority Data

Apr. 2, 1979 [EP] European Pat. Off. ..... 79850019.5
Oct. 9, 1979 [SE] Sweden ..... 7908348

[51] Int. Cl.[3] ..... A47L 15/14; A47L 15/42; B08B 3/02; B24C 7/00

[52] U.S. Cl. ..... 15/3; 134/7

[58] Field of Search ..... 51/424, 425, 317, 319, 51/320, 321, 292, 16; 15/3, 95; 134/103, 104, 109, 111, 7, 10

[56] References Cited

U.S. PATENT DOCUMENTS

| | | | |
|---|---|---|---|
| 1,919,541 | 7/1933 | Davis | 15/3 |
| 2,597,132 | 5/1952 | Smith | 134/111 |
| 2,744,532 | 5/1956 | Zademach | 134/179 |
| 3,012,262 | 12/1961 | Mori | 15/95 |
| 3,082,779 | 3/1963 | Jacobs | 134/111 |
| 3,110,317 | 11/1963 | Faust et al. | 134/174 |
| 3,323,159 | 6/1967 | Ummell et al. | 15/3 |
| 4,143,669 | 3/1979 | Minken | 134/153 |
| 4,213,475 | 7/1980 | Minken | 134/111 |

*Primary Examiner*—Stephen G. Kunin
*Assistant Examiner*—Robert A. Rose

[57] ABSTRACT

Cleaning machine for blasting the goods to be cleaned. Inside a liquid container there is provided a liquid-permeable compartment or cassette providing a magazine for the granules and connected to a bottom outlet in a treatment chamber wherein the blasting shall take place. The compartment or cassette is connected by a valve-controlled opening to the suction side of a pump for sucking-in liquid from the liquid container via the cassette, while carrying granules therefrom and for supplying the liquid containing granules to the treatment chamber from which the granules are again supplied to the cassette through the bottom outlet.

24 Claims, 14 Drawing Figures

CLEANING MACHINE WITH PARTICULATE ABRASIVE

BACKGROUND OF THE INVENTION

The invention relates to a cleaning machine with means for blasting the goods to be cleaned by means of liquid containing granules, comprising a treatment chamber for receiving the goods, a liquid container, pump means the suction side of which is connected to the liquid container for sucking-in liquid, nozzle means connected to the pressure side of the pump means for ejecting liquid towards the goods in the treatment chamber, and means for supplying granules to liquid supplied to the nozzle means, and for separating granules from liquid ejected from the nozzle means.

Cleaning machines in which blasting of the goods to be cleaned is applied are used for instance for washing heavily soiled goods with adhering food residues which are difficult to resolve and remove only by spraying liquid containing conventional dishwashing detergents. In a prior art embodiment (DAS No. 1.148,360) of a dishwashing machine of this type, commonly called heavy-duty dishwashing machine, the granules are located on a grid in the treatment chamber below the goods to be washed, and by forcing liquid from below through the grid said granules are thrown towards the goods together with the liquid. The arrangement is not satisfactory because the liquid containing granules cannot without difficulty be directed towards the goods to be washed in such a manner that an optimally effective cleaning of the goods is achieved. In another embodiment (U.S. Pat. No. 1,761,492) granules formed as balls are introduced by means of an injector into the liquid when it is ejected towards the goods to be washed, and are then separated from the liquid again by means of a grid when the liquid leaves the goods, to be forwarded to the injector by means of separate conveyor means in order to be introduced into the liquid again. Such an arrangement is effective per se, but the conveyor means provides a complication because it fails easily during operation of the machine and can hardly operate with relatively small granules.

The invention aims at providing a cleaning machine of the type initially referred to in which the granules are supplied and separated by means of a constructively simple arrangement in a reliable manner also as far as small granules are concerned, and which at the same time provides the possibility to direct the liquid containing granules by means of the nozzle means in the most suitable angle of incidence towards the goods in order to obtain an optimally effective cleaning of the goods.

In order to achieve this the cleaning machine according to the invention is characterized in that the last-mentioned means comprises a liquid-permeable compartment which is located inside the liquid container with a bottom outlet in the treatment chamber connecting to the liquid container via the liquid-permeable compartment, and in that this compartment is connected through a valve-controlled opening to the suction side of the pump means for supplying the granules to the liquid through this opening such that liquid containing the granules is sucked-up and circulated by the pump means, or alternatively retaining the granules in the liquid-permeable compartment such that liquid only is sucked-up and circulated by the pump means.

In an introductory part of a cleaning cycle during the so-called prerinsing it may be desired to wash off and collect material adhering relatively loosely to the goods before the washing proper is started by blasting the goods by means of the liquid containing granules, because such blasting will not be particularly efficient as far as thick and relatively soft layers of contaminants are concerned, e.g. such food residues on the goods to be washed, which have not got dried or have burnt to such goods. Also detergents are not particularly efficient when acting upon such soft and sometimes perhaps rather thick layers of contaminants.

In order to spray the goods to be cleaned, with liquid only while detached contaminants are being separated from the liquid there is arranged in the bottom outlet, according to a further development of the invention, an adjustable member coordinated with the valve control for passing liquid from the treatment chamber directly to the liquid-permeable compartment and, alternatively, through a strainer in the bottom outlet.

In order to illustrate the invention embodiments of a heavy-duty dishwashing machine according to the invention will be described in more detail below, reference being made to the accompanying drawings.

Figure 1:
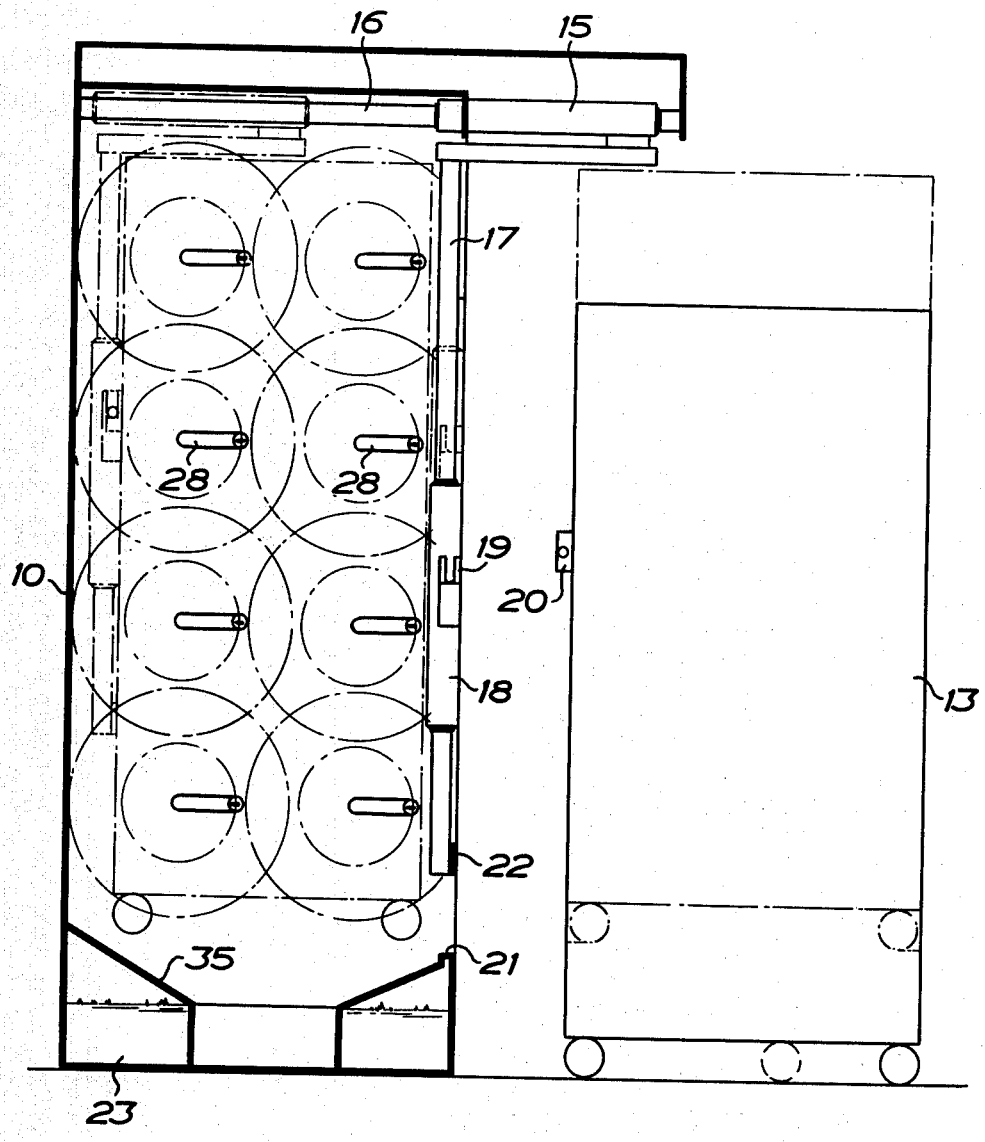
FIG. 1 is a vertical sectional view of the heavy-duty dishwashing machine in one embodiment thereof with a carriage for supplying the goods to be washed to the treatment chamber of the machine, shown in side view.
Figure 2:
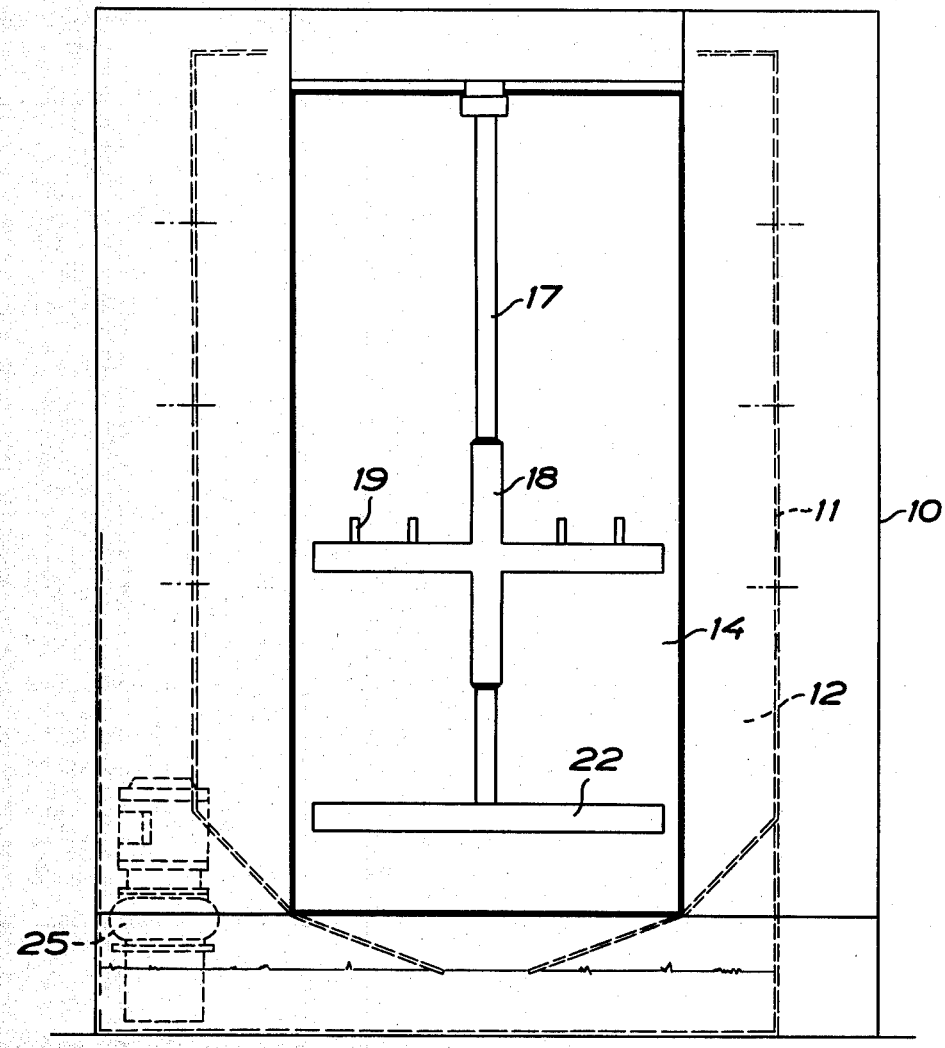
FIG. 2 is a front view of the dishwashing machine from the end thereof where the carriage shall enter.
Figure 4:
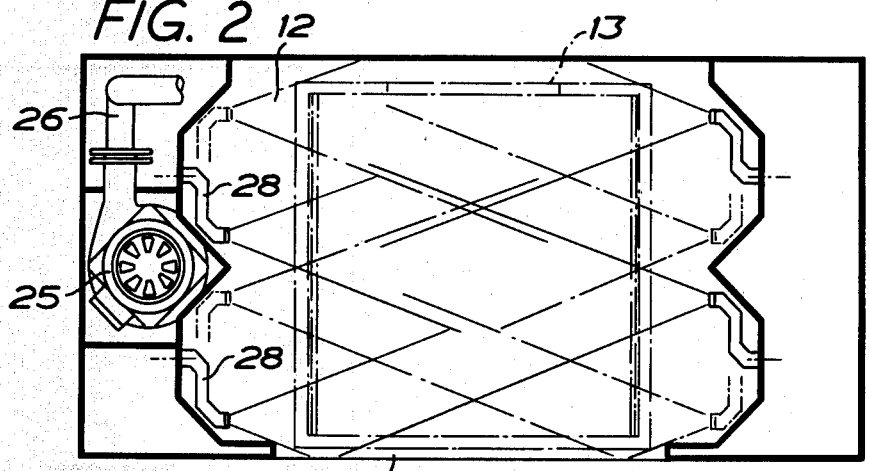
FIG. 4 is a horizontal sectional view of the dishwashing machine and shows the location of the carriage inside the treatment chamber.
Figure 3:
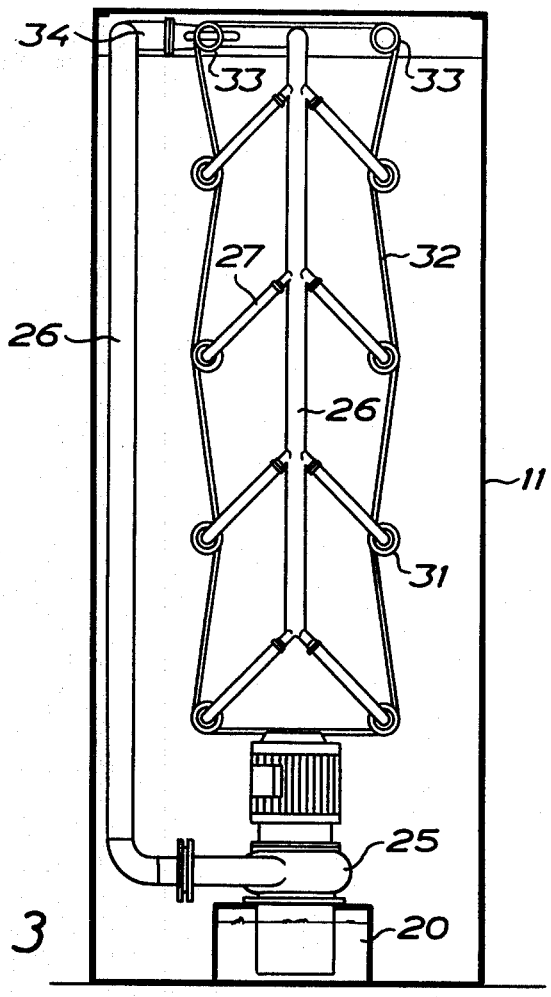
FIG. 3 is a side view of the dishwashing machine and shows the pump means and drive means for the nozzles.
Figure 5:
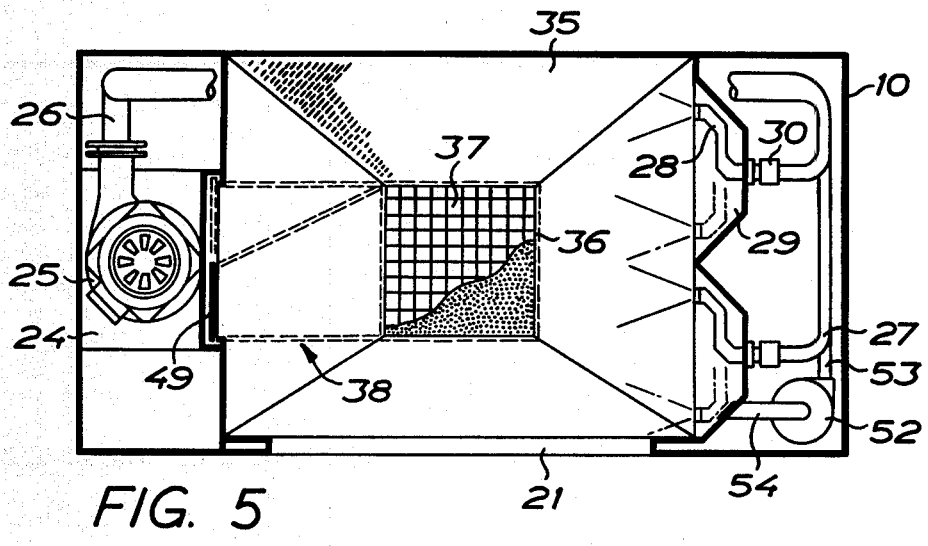
FIG. 5 is a corresponding horizontal sectional view with the bottom of the treatment chamber shown in plan view, partly in sectional view.
Figure 6:
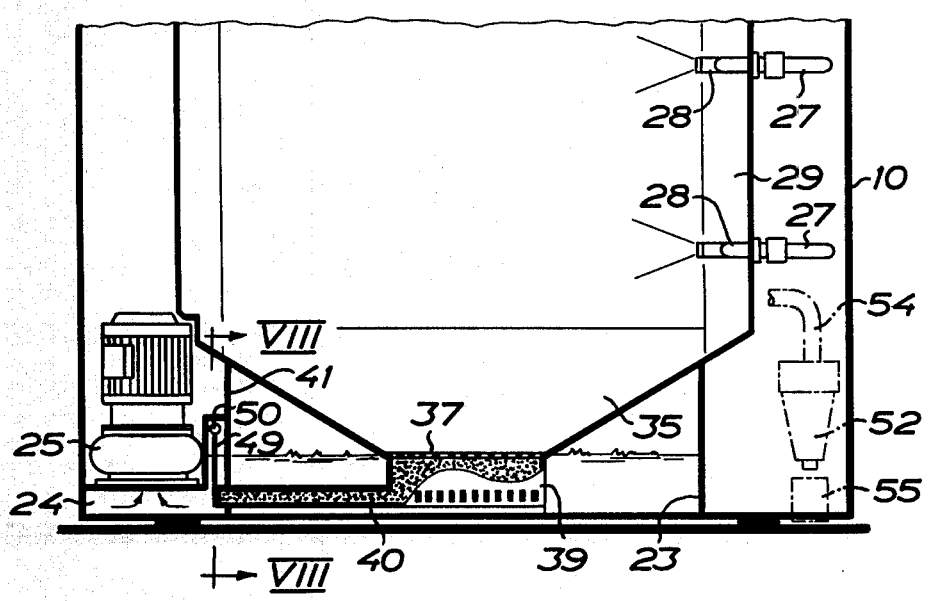
FIG. 6 is a vertical sectional view of the lower portion of the dishwashing machine taken perpendicularly to the view in FIG. 1, and discloses the means for separating the granules from the liquid ejected from the nozzles, and for storing the granules.
Figure 7:
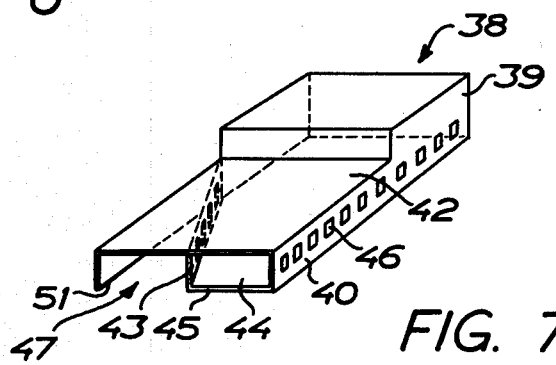
FIG. 7 is a perspective view of a cassette forming the compartment for receiving and storing the granules.
Figure 8:
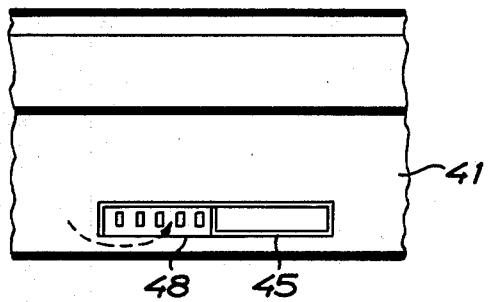
FIG. 8 is a fragmentary view taken along line VIII—VIII in FIG. 6 and illustrates the cassette in end view as seen towards the end of the cassette, which opens into the pump chamber.
Figure 9:
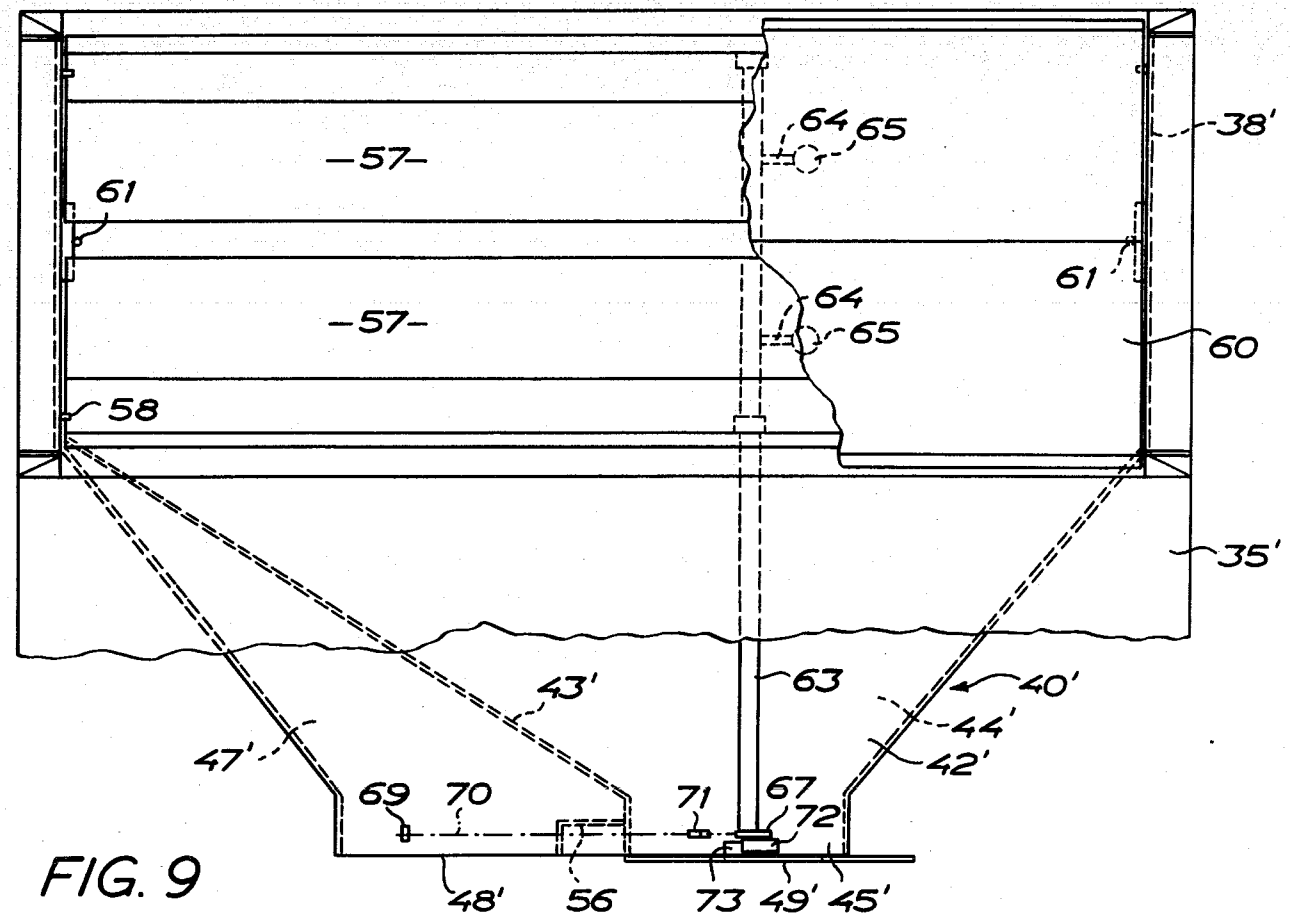
FIG. 9 is a fragmentary plan view of the bottom in the treatment chamber with the liquid-permeable compartment arranged therein and the associated valve-controlled openings in a modified embodiment of the cleaning machine according to the invention.
Figure 10:
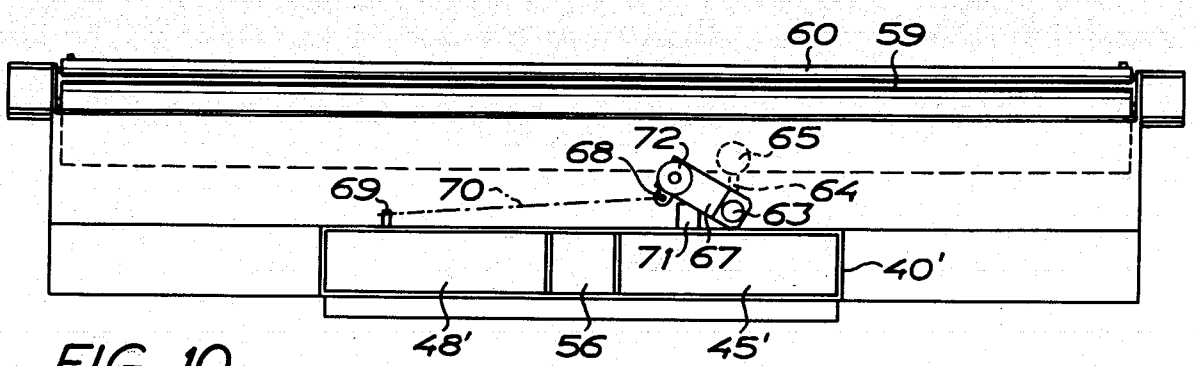
FIG. 10 is an elevational view of the liquid-permeable compartment in the embodiment of FIG. 9 as seen from the valve-controlled openings.
Figure 11:
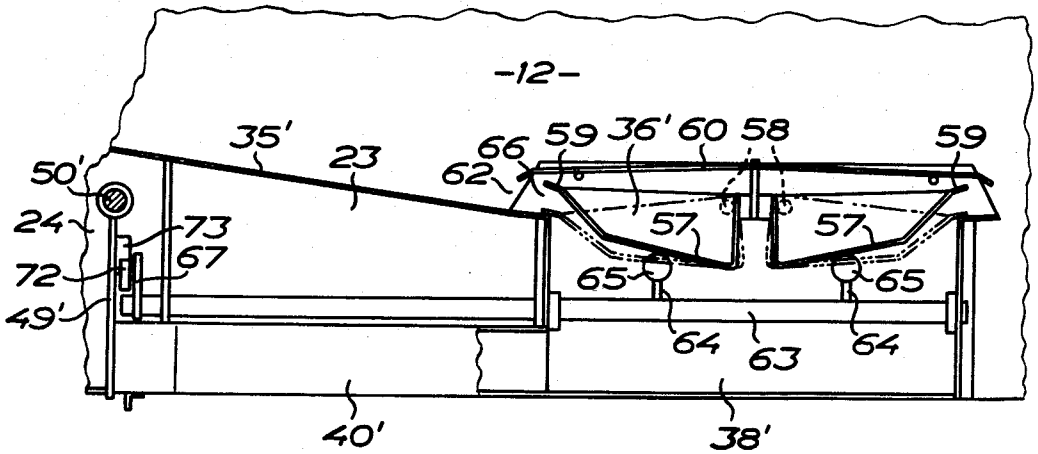
FIG. 11 is a vertical sectional view of the liquid-permeable compartment in the embodiment of FIGS. 9 and 10 with strainer troughs which are arranged in the bottom outlet of the treatment chamber and are operatively connected to the valve of the valve-controlled openings to be adjusted between operative and inoperative positions.
Figure 12:
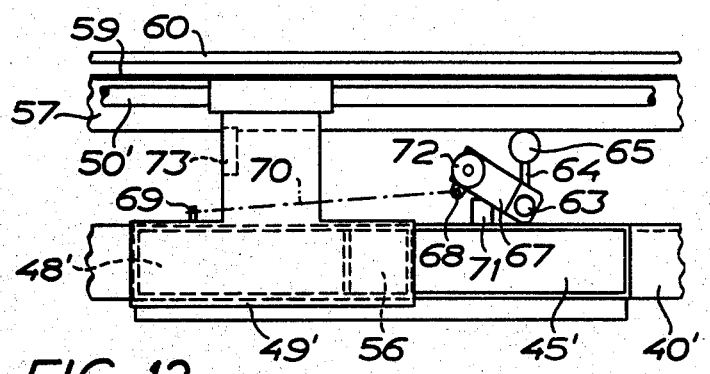
FIG. 12 is a fragmentary elevational view of the liquid-permeable compartment in the embodiment of FIGS. 9 to 11 as seen from the valve-controlled openings, the valve being shown in position for blasting the goods to be cleaned and the strainer troughs being shown in inoperative position.
Figure 13:
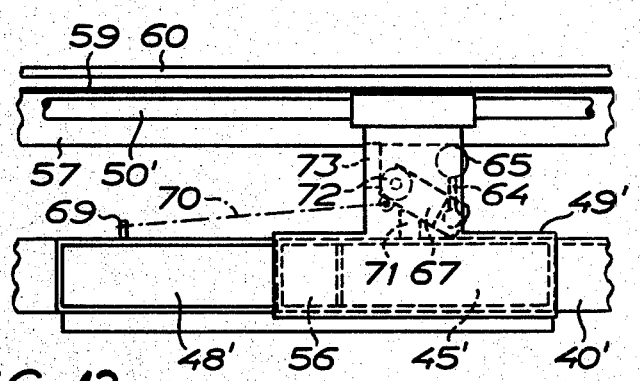
Figure 14:
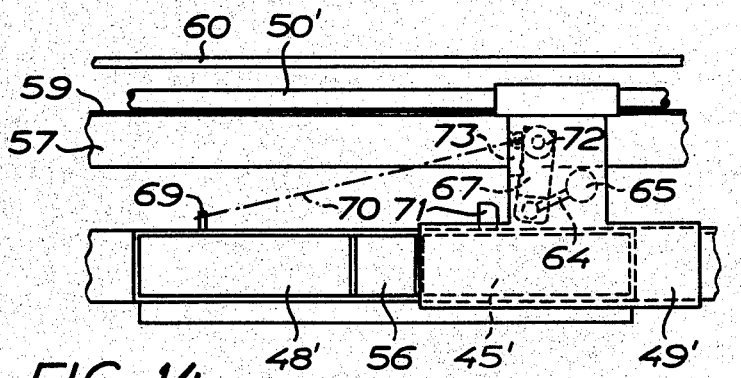

FIG. 13 is a view similar to that in FIG. 12, the valve being shown in position for rinsing the goods in the treatment chamber with clean liquid and the strainer troughs being shown in inoperative position for collecting the granules used for the blasting, in the liquid-permeable compartment; and FIG. 14 is a view similar to that in FIG. 12, the valve being shown in position for rinsing the goods in the treatment chamber with clean liquid and the strainer troughs being shown in operative position for collecting contaminants entrained in the liquid.

The heavy-duty dishwashing machine shown in FIGS. 1 to 8 comprises an outer casing 10 in which a treatment chamber 12 for the goods to be washed is defined by inside walls 11. For the supply of the goods to be washed, supported on a carriage 13, to this treatment chamber there is provided at an entrance 14 which can be closed by means of doors not shown, a carriage elevator by means of which the carriage can be lifted from the floor level and can be displaced into the treatment chamber. The carriage elevator comprises a cradle 15 which can be displaced hydraulically on a horizontal support rail 16 arranged centrally at the top of the treatment chamber said rail projecting from the treatment chamber through the entrance 14. The cradle 15 supports a vertically mounted guide rail 17 on which a cross-formed lift slide 18 can be displaced hydraulically up and down. The lift slide has a number of hooks 19 to engage from below brackets 20 on the carriage 13 when the cradle 15 is in an outer end position on the support rail 16 and the lift slide is in a lower end position on the guide rail 17 and is then displaced upwardly to lift the carriage sufficiently to the position indicated by dot and dash lines so that the carriage clears the sill 21 in the entrance 14 at succeeding displacement of the carriage elevator and the carriage suspended thereon into the treatment chamber 12 from the outer end position to an inner end position shown by dot and dash lines in FIG. 1, by the cradle 15 being displaced along the support rail 16. An abutment 22 is provided on the guide rail 17 to support the carriage 13 when suspended from the carriage elevator.

The arrangement described provides a rational handling of the goods to be washed because this goods can be shelved on the carriage at different collecting places and then easily can be moved into the heavy-duty dishwashing machine without substantial manual work, but it is of course also possible to arrange the heavy-duty dishwashing machine with shelves or guides for the insertion of baskets and racks manually into the treatment chamber.

The lower portion of the cabinet 10 is formed as a liquid container 23 below the treatment chamber 12, and this liquid container is enlarged to form a closed suction chamber 24 to which a pump 25 driven by an electric motor is connected with the suction side thereof. The pressure side of the pump is connected to a pressure conduit 26 which in turn is connected by distribution conduits 27 to a number of nozzles 28 rotatably mounted in two vertical rows on two opposite side walls of the treatment chamber in niches 29 formed by these side walls. The connection between the nozzles 28 which are cranked, and the distribution conduits 27 is provided by pivot couplings 30. For the rotation of the nozzles these are provided with sprockets 31, and an endless chain 32 engages these sprockets said chain also running over two conducting sprockets 33 at the top. One of these conducting sprockets is connected to an electric drive motor 34. It will be seen that the chain 32 is extended alternatingly at one side and the other of the sprockets 31 so that the nozzles 28 in a row are driven alternatingly in one direction and the other.

The treatment chamber 12 has a bottom 35 which is perforated to the extent it covers the liquid container 23. It slopes as a funnel towards a central opening 36 covered by a grid 37. Chamber 12 communicates with container 23 through opening 36 via a compartment 38 formed as a cassette which is shown separately in FIG. 7. The cassette is connected to the opening 36 at a square socket 39 and a conduit portion 40 of the cassette, having the same width as the socket, extends through the side wall 41 of the container 23 into the closed suction chamber 24 wherein it opens. The cassette 38 is arranged to be easily removable from the heavy-duty dishwashing machine by being lifted at the socket 39 and being withdrawn through the opening 36. It serves as a magazine for the granules used as an addition to the liquid to provide a mechanical working of the goods to be washed by liquid blasting. The perforation of the bottom 35 consists of sufficiently small openings so as not to let through the granules as long as they are not worn due to the use thereof in the machine to such extent that they are no longer effective for the purpose thereof while the grid 37 on the contrary has sufficiently large openings to let through unobstructedly the granules to the cassette 38.

The conduit portion 40 of the cassette 38 has an upper bounding wall 42 which extends over the entire width of the cassette. By means of a partition wall 43 extending angularly through the conduit portion 40 there is defined a passage 44 the opening of which at the end connected to the socket 39 has the same width as the conduit portion while the opening at the other end indicated at 45 and opening into the suction chamber 24 has a width which is only half the said width. Gill openings 46 possibly covered by a close-meshed netting to retain the granules in the cassette are provided in the side walls of the socket 39 and the passage 44 such that water can pass between the interior of the cassette 38 and the liquid container 23.

The partition wall 43 also defines a passage 47 in the conduit portion 40, which is open at the bottom thereof and also opens into the suction chamber 24 through an opening 48 of the same size as the opening 45. A plate valve 49 is displaceable on a horizontal bar 50 and is of a size to cover completely only one of the openings 45 and 48 at a time, viz. when it is located at one and the other end position thereof, respectively, on the bar 50. In intermediate positions the valve covers each opening more or less. Means can be provided for displacement of the valve 49 manually or by means of a servo on the bar 50 but such means which can be of a known construction are not shown here.

If it is assumed that the liquid container 23 contains liquid and that the granules to be added to the liquid from the beginning are contained in the cassette 38 the opening 48 of which is assumed to be closed while the opening 45 is open, granules will be carried by the liquid when this is sucked-up by the pump 25 from the suction chamber 24 because the suction chamber 24 is connected to the liquid container 23 through the passage 44 of the cassette only. Due to the fact that the liquid then will flow into the passage 44 from the sides through the gill openings 46 the granules will be agitated by turbulence of the liquid and will be carried away by the liquid flow to the pump without being packed in the passage 44. The liquid containing granules is expelled from the nozzles 28 at the pressure side of the pump and is thrown towards the goods to be washed on the carriage 13 in order to provide the cleaning effect thereof. Liquid and granules as well as accompanying contaminants then fall down to the bottom 35 of the treatment chamber 12 where liquid and granules are separated. The granules pass through the grid 37 and the opening 36 into the cassette 38 where they are again carried away by the liquid as this is being sucked-up by the pump 25 from the container 23 via the suction chamber 24.

The advantage of arranging the supply of the granules to the liquid in this manner is above all, as mentioned above, that there will be no accumulation of packed granules, which could prevent the circulation of the liquid, but also that the addition of granules can be controlled and can be brought to cease completely. If the valve 49 is displaced to the end position in which the valve covers the opening 45 the pump will draw liquid only from the container 23 through the passage 47 and the suction chamber 24, and with the valve in positions between said two end positions granules will be mixed with the liquid more or less. The adjustment of the valve is preferably controlled from a timer which controls also other functions of the heavy-duty dishwashing machine.

When the pump 25 is sucking liquid through the passage 47, the liquid is forced to pass from the container 23 below the lower edge 51 of the side wall of the cassette 38, bounding the passage 47, and it is prevented thereby that air will be sucked-in by the pump.

The granules used in the heavy-duty dishwashing machine according to the invention preferably consist of plastics material such as Nylon or Delrin. The granules need not be spherical but can have any form; they can comprise for instance small polyhedrons or cylinders. The substantially spherical form is preferred, however, because balls have no tendency of adhering to the goods to be washed in the manner that can occur as far as granules with plane surfaces are concerned. As guidance for the dimensioning of the granules and the adjustment of other factors affecting the cleaning action of the granules the following specification is given:

| | |
|---|---|
| Mass of the granules max. | 0.2 g |
| Size of the granules | 0.5–5 mm |
| Spec. gravity of the granules | 0.8–1.9 |
| Velocity of the granules from the nozzles | 4–35 m/sec |
| Nozzle area | 0.3–3 $cm^2$ |

The amount of granules should comprise between 10 and 50 percent by volume of the circulating liquid and preferably should be 20 to 40 percent by volume.

Excellent results have been obtained by granules formed as substantially spherical bodies of Delrin having a diameter of substantially 3 mm when washing such heavily soiled goods as exist in catering centers and restaurants and comprise stainless utensils such as trays, pans, dish-plates, etc. where the existing radius of curvature practically never is less than 3 mm. When impinging against such goods balls having a diameter of 3 mm can enter into and work also the smallest existing nooks and corners of the goods.

The following values of the parameters given above, which have been obtained from experience, have been found to provide optimum cleaning action when Delrin balls having a diameter of 3 mm, are being used:

| | |
|---|---|
| The mass of the balls | 0.01946 g |
| The spec. gravity of the balls | 1.40 |
| Velocity | 13.18 m/sec |
| Nozzle area | 1.267 $cm^2$ |
| Amount of balls | abt 35 percent by volume |

Since the cleaning in the heavy-duty dishwashing machine according to the invention is effected by the simply mechanical effect on food residues adhering to the goods to be washed the temperature of the circulating liquid can be kept low without any detrimental effect on the result; on the contrary, a low temperature is advantageous because it is thereby avoided that proteins in the food residues coagulate and adhere still more firmly to the goods. By means of the granules the food residues are broken and comminuted so that they can be easily removed by the circulating liquid.

A typical dishwashing program in the heavy-duty dishwashing machine according to the invention can comprise the following different steps:

1. Prerinsing at about 38° C. without granules for 30 sec.
2. Dishwashing with granules at 38° C. for 3 to 10 min.
3. Final rinsing at 38° C. without granules for 30 sec for returning the granules to the cassette 38 the opening 45 being closed.
4. Final flushing at 90° C. without granules for 15 sec for disinfection of the goods and for facilitating draining and drying.

When liquid containing granules is being circulated friction heat is generated to some extent by the granules impinging against the goods to be washed, and in the dishwashing cycle described this friction heat can be sufficient in order to maintain the temperature at about 38° C. if the liquid supplied has substantially this temperature from the beginning.

In the steps 1 to 3 the same liquid can be used for the dishwashing. For cleaning this liquid between the steps the dishwashing machine can be provided with a hydrocyclone 52 which is connected at the inlet side thereof to a conduit 53 which communicates with the pressure conduit 26, and is connected at the outlet side thereof to a conduit 54 opening into the treatment chamber 12 so that liquid without granules can be pumped through the hydrocyclone between the steps 1 and 2 and between the steps 2 and 3, respectively, or part of the liquid can be pumped continuously through the hydrocyclone during the steps 1 and 3. In the cyclone entrained food residues are separated and discharged to a drain 55. After the step 3 the liquid is discharged to the drain and then fresh, clean liquid at the temperature 90° C. is supplied for the final flushing. All these operations can be controlled from the timer by means of solenoid valves.

Referring to FIGS. 9 to 14 in the drawings, elements in the embodiment described below, which are substantially identical with elements in FIGS. 1 to 8, are identified by the same references as in the last-mentioned figures, sometimes with the addition of a prime, in order to indicate some modification of the elements.

In the embodiment shown in FIGS. 9 to 14 the goods to be cleaned can be prerinsed with liquid only according to step 1 in the dishwashing program above, contaminants being rinsed off from the goods and separated for collection.

The bottom 35' of the treatment chamber 12 is non-perforated and slopes as a funnel towards the central opening 36' which is elongated in this embodiment. Chamber 12 communicates through this opening with the liquid container 23 through the compartment 38' which also in this embodiment can comprise a removable cassette and is connected to the opening 36'. The conduit portion 40' extends from the liquid container 23 into the suction chamber 24 wherein it opens. The compartment 38' also in this case serves as a magazine for the granules.

The upper bounding wall 42' of the conduit portion 40' extends over the entire width of said conduit portion. The partition wall 43' extending angularly through the conduit portion 40' defines the passage 44' the opening of which at the end connected to the bottom outlet 36' extends over the entire width of the conduit portion, while the opening at the other end indicated at 45° and opening into the suction chamber 24 extends over nearly half the width of the conduit portion 40' at this end. The compartment 38' and the passage 44' of the conduit portion 40', which is connected to said compartment, has openings (not shown) corresponding to the gill openings 46 in the embodiment of FIGS. 1 to 8 so that water can pass between the compartment 38' and the liquid container 23 said openings being small enough to retain the granules in said compartment.

The partition wall 43' also defines the passage 47' open at the bottom, which opens into the suction chamber 24 through an opening 48' of substantially the same size as the opening 45'. However, a wall 56 is arranged between said openings 45' and 48'.

The plate valve 49' is displaceable on the horizontal bar 50' and is of a size to cover completely only one of the openings 45' and 48' at a time. viz. when it is located at one and the other end position thereof, respectively, on the bar 50'. The valve can move from each end position over a distance corresponding to the width of the wall 56 between the openings 45' and 48' and only after that the valve begins to open the opening which has been closed so far, and to close the other opening in order to cover each opening more or less in intermediate positions of the valve. Means are provided for displacing the valve 49' by means of a servo on the bar 50' but such means which can be of known construction and can comprise e.g. a hydraulic cylinder are not shown here.

The bottom outlet 36' in the treatment chamber 12 is provided with two strainers 57. Each of these strainers is formed as a trough having a perforated bottom and is supported on horizontal pins 58 for pivotal movement about a horizontal axis at one longitudinal edge thereof, viz. the edge adjacent the centre of the outlet opening. The other longitudinal edge is provided with a flange 59 in order that the strainer shall engage the bottom 35 of the treatment chamber at this flange adjacent the bottom outlet 36'. The two strainers are covered by a saddle-roof cover 60 which is removably mounted on support pins 61 and covers the strainers leaving a gap 62 between the edge of the cover and the bottom of the treatment chamber.

A shaft 63 is rotatably mounted in the walls of the liquid container 23 and extends below the strainers 57 transversely of the pivot axes thereof. Below each strainer there is provided on the shaft a radially projecting arm 64 having a ball 65 at the free end thereof and the arm can be engaged with the lower side of the bottom of the associated strainer at this ball. By adjustment of the shaft 63 to a rotational position thereof wherein the arms 64 are in an upright position the strainers 57 can be kept in the position shown in solid lines in the drawings, in which there is a gap 66 between the bottom 35' of the treatment chamber and the flange 59. By rotation of the shaft 63 in order to lower the arms 64 the strainers can be lowered pivoting on the pins 58, to the position shown by dot and dash lines in the drawings, in which the flange 59 rests on the bottom 35'. The first-mentioned position is an inoperative position of the strainers because liquid sprayed into the treatment chamber and flowing down onto the bottom 35' or the cover 60 can flow into the compartment 38' through the gap 62 and then through the gap 66 without passing through the strainers 57, while the other position is the operative position of the strainers because the liquid flowing down will pass into and through the strainers 57 after having passed through the gap 66.

The shaft 63 extends up to the valve 49' in the suction chamber 24 where the shaft is provided with an arm 67 fixedly mounted on the shaft at an angle of 60° in relation to the arms 64. Between a lug 68 on the arm 67 and a lug 69 on the conduit portion 40' a tension spring 70 is engaged biasing the shaft 63 in counter-clockwise direction as seen in FIGS. 10, 12, 13, and 14. Under the bias of this spring the arm 67 is held in engagement with a stationary abutment 71 on the conduit portion 40' and then the arms 64 are in the substantially upright position wherein the strainers 57 are lifted to the inoperative position shown in FIG. 11 by solid lines.

The arm 67 is provided with a rotatably mounted roller 72 to co-operate with a projecting abutment 73 on the valve 49' and this abutment is arranged to engage the roller 72 when the valve 49' is displaced from the left position to the right position as seen in FIGS. 12, 13, and 14 to swing the arm 67 in clock-wise direction against the bias of the spring 70.

If it is assumed that the liquid container 23 contains liquid and that the granules to be added to the liquid at the beginning are contained in the compartment 38' the opening 48' of which is assumed to be closed while the opening 45' is open—the valve accordingly is in the position of FIG. 12—the granules will be carried along by the liquid when the liquid is being sucked-up by the pump from the suction chamber 24 because the suction chamber is connected with the liquid container 23 through the passage 44' of the conduit portion 40' only. The liquid containing granules is expelled through the nozzles in the treatment chamber to exert the cleaning action thereof on the goods to be cleaned, which is received by the treatment chamber. Liquid and granules then fall onto the bottom 35' and the cover 60, respectively, in the treatment chamber 12, the granules passing through the gap 62 and then through the gap 66 into the compartment 38' where they can be carried along again by the liquid being sucked-up by the pump from the container 23 through the suction chamber 24. The liquid with the granules entrained therein thus does not pass through the strainers 57 when the valve 49' is in the position of FIG. 12 because the abutment 73 in this position of the valve does not engage the roller 72, the arm 67 being engaged with the abutment 71 with the arms 67 in the upright position and with the strainers 57 lifted.

Now, if the valve 49' is displaced to the position of FIG. 13, wherein the left hand edge of the valve has uncovered completely the opening 48' and the valve covers completely the opening 45' as well as the wall 56, the pump will draw liquid only from the container 23 through the passage 47' and the suction chamber 24, and with the valve in positions intermediate said two positions granules will be mixed with the liquid to a greater or smaller extent. In the position of FIG. 13, the abutment 73 has just contacted the roller 72 and accordingly the arm 67 is still in the same position as in FIG. 12 wherein the strainers 57 are lifted to the inoperative position thereof. The position of the valve 49', shown in FIG. 13, is used at the end of the blasting in order that the granules will be flushed into the compartment 38' without being carried along again by the liquid to the treatment chamber.

If the valve 49' is displaced further to the right from the position of FIG. 13 to the position of FIG. 14, the pump will still be drawing liquid only without granules because the opening 48' of the conduit portion 40' is open and the opening 45' of said conduit portion still is closed. However, in this position the arm 67 has been swung in counter-clockwise direction against the bias of the spring 70 due to the fact that the arm has been carried along at the abutment 73 engaging the roller 72 so that the arms 64 have been swung down and the strainers 57 have been lowered to the operative position shown by dot and dash lines in FIG. 11. The liquid sprayed into the treatment chamber 12 thus will flow into the compartment 38' through the strainers 57 because the gap 66 no longer exists when the strainers are in the operative position. It is the intention that the position of FIG. 14 shall be used in prerinsing the goods to be treated in the treatment chamber 12 so that coating adhering loosely to the goods will be rinsed off and will be collected in the strainers 57 during such prerinsing.

The valve preferably is controlled from the timer controlling the other operations of the heavy-duty dishwashing machine. Inductive sensors can be provided for sensing the different positions of the valve shown in FIGS. 12, 13, and 14. The operative connection between the valve 49' and the strainers 57 provides a positive adjustment of the strainers in dependance of the adjustment of the valve but as will be realized, the connection between the adjustment of the valve and the adjustment of the strainers can be arranged in another way than by mechanical means as in the embodiment described. For example, separate adjustment means can be provided for the strainers 57, such adjustment means being controller directly from the timer, such control being coordinated with the control of adjustment means for the valve 49'.

An advantage of the embodiment of FIGS. 9 to 14 wherein the strainers 57 proper form adjustable members for passing the liquid flow from the treatment chamber 12 alternatively through the strainers and past the strainers is that there is achieved a simple construction as well as that food residues collected in the strainers continuously will be maintained in a humid condition due to the fact that liquid passes below the strainers when these are in the lifted inoperative position.

Preferably, the strainers are arranged such that they can easily be lifted and taken out from the machine when the material collected therein is to be removed.

I claim:

1. In a cleaning machine with means for blasting the goods to be cleaned by means of liquid containing granules, comprising a treatment chamber for receiving the goods; a liquid container; pump means, the suction side of which is connected to the liquid container for sucking-in liquid; nozzle means connected to the pressure side of the pump; means for ejecting liquid towards the goods in the treatment chamber; and means for supplying granules to liquid supplied to the nozzle means, and for separating granules from liquid ejected from the nozzle means; the improvement which comprises as the means for supplying granules to liquid supplied to the nozzle means and separating granules from liquid ejected from the nozzle means, a liquid-permeable compartment which is located inside the liquid container with a bottom outlet in the treatment chamber connecting to the liquid container via the liquid-permeable compartment; said compartment being connected through a valve-controlled opening to the suction side of the pump means for supplying the granules to the liquid through this opening, such that liquid containing the granules is sucked-up and circulated by the pump means, or alternatively retaining the granules in the liquid-permeable compartment such that liquid only is sucked-up and circulated by the pump means, the suction side of the pump means being connected to a suction chamber communicating with the liquid container, into which the valve-controlled opening opens; and a conduit portion of the liquid-permeable container extending through the liquid container from the bottom outlet of the treatment chamber into the suction chamber.

2. Cleaning machine according to claim 1, the conduit portion being divided into a first passage which communicates with the bottom outlet of the treatment chamber and is connected by the valve-controlled opening to the suction chamber and through openings in the bounding walls of the passage communicates with the liquid container; and into a second passage which communicates with the liquid container and which is connected by a valve-controlled opening to the suction chamber.

3. Cleaning machine according to claim 2, in which the openings of the first and second passages communicating with the suction chamber are controlled by a common valve for uncovering one opening when covering the other, and vice versa.

4. Cleaning machine according to any of claims 1, 2 and 3, in which the granules have a maximum mass of 0.2 g, a size between 0.5 and 5 mm, and a specific gravity between 0.8 and 1.9.

5. Cleaning machine according to claim 4, in which the granules have a mass of about 0.03 g, a size of about 3 mm, and a specific gravity of about 1.4.

6. Cleaning machine according to claim 1 in which the nozzles connected to the pressure side of the pump means are arranged in two opposite side walls of the treatment chamber and are directed towards each other from these side walls.

7. Cleaning machine according to claim 6, in which the nozzles are rotatable and are connected to drive means for rotating same.

8. In a cleaning machine with means for blasting the goods to be cleaned by means of liquid containing granules, comprising a treatment chamber for receiving the goods; a liquid container; pump means, the suction side of which is connected to the liquid container for sucking-in liquid; nozzle means connected to the pressure side of the pump; means for ejecting liquid towards the goods in the treatment chamber; and means for supplying granules to liquid supplied to the nozzle means, and for separating granules from liquid ejected from the nozzle means, the improvement which comprises as the means for supplying granules to liquid supplied to the nozzle means and separating granules from liquid ejected from the nozzle means, a liquid-permeable compartment which is located inside the liquid container with a bottom outlet in the treatment chamber connecting to the liquid container via the liquid-permeable compartment; said compartment being connected through a valve-controlled opening to the suction side of the pump means for supplying the granules to the liquid through this opening, such that liquid containing the granules is sucked-up and circulated by the pump means; or alternatively retaining the granules in the liquid-permeable compartment such that liquid only is sucked-up and circulated by the pump means, and having an adjustable member coordinated with the valve control arranged in the bottom outlet for passing liquid from the treatment chamber directly to the liquid-permeable compartment or, alternatively, through a strainer in the bottom outlet.

9. Cleaning machine according to claim 8, in which the strainer forms said adjustable member, the strainer being adjustable between an operative position wherein the strainer connects to the bottom of the treatment chamber to receive liquid flowing from the bottom, and an inoperative position in which the strainer is lifted from the bottom to leave a liquid passage between the lower side of the strainer and the bottom of the treatment chamber.

10. Cleaning machine according to claim 9, in which the strainer is covered by a cover defining an inlet opening to the strainer in relation to the bottom of the treatment chamber.

11. Cleaning machine according to claim 9 or 10 in which the strainer is pivotally mounted.

12. In a cleaning machine wherein the goods to be cleaned are treated with liquid containing granules, comprising a treatment chamber for receiving the goods and having a bottom outlet; a liquid container; pump means; a first connection between the suction side of the pump means and the liquid container; nozzle means connected to the pressure side of the pump; means for ejecting liquid towards the goods in the chamber; and means for supplying granules to the liquid supplied to the nozzle means, and for separating granules from liquid ejected from the nozzle means; the improvement which comprises as the means for supplying granules to liquid supplied to the nozzle means and separating granules from liquid ejected from the nozzle means, a liquid-permeable container which is located inside the liquid container for supplying granules to the liquid, the bottom outlet of the treatment chamber being connected to the liquid container via the liquid-permeable container; a second connection between the suction side of the pump means and the liquid-permeable container; and valve means for controlling the opening and closing of the first connection between the suction side of the pump means and the liquid container; and of the second connection between the suction side of the pump means and the liquid-permeable container for supplying granules to the liquid sucked up by the pump means, or alternatively retaining the granules in the liquid permeable container, in a manner such that when the first connection is open and the second connection is closed, the granules are retained in the liquid-permeable container and only liquid is sucked up by the pump means, and when the first connection is closed and the second connection is open, only liquid containing granules from the liquid-permeable container is sucked up by the pump means; said valve means having intermediate positions in which both connections are partially open in positions intermediate their fully open and fully closed positions.

13. Cleaning machine according to claim 12 in which the suction side of the pump means is connected to a suction chamber communicating with the liquid container, into which the valve-controlled opening opens.

14. Cleaning machine according to claim 13, in which a conduit portion of the liquid-permeable container extends through the liquid container from the bottom outlet of the treatment chamber into the suction chamber.

15. Cleaning machine according to claim 14, in which the conduit portion is divided into a first passage which communicates with the bottom outlet of the treatment chamber and is connected by the valve-controlled opening to the suction chamber and through openings in the bounding walls of the passage communicates with the liquid container; and a second passage which communicates with the liquid container and which is connected by the valve-controlled opening to the suction chamber.

16. Cleaning machine according to claim 15, in which the openings of the first and second passages communicating with the suction chamber are controlled by the said valve for partially uncovering one opening while covering the other, and vice versa.

17. Cleaning machine according to any of claims 12 to 16 in which the granules have a maximum mass of 0.2 g, a size between 0.5 and 5 mm, and a specific gravity between 0.8 and 1.9.

18. Cleaning machine according to claim 17, in which the granules have a mass of about 0.03 g, a size of about 3 mm, and a specific gravity of about 1.4.

19. Cleaning machine according to claim 12 in which the nozzles connected to the pressure side of the pump means are arranged in two opposite side walls of the treatment chamber and are directed towards each other from these side walls.

20. Cleaning machine according to claim 19, in which the nozzles are rotatable and are connected to drive means for rotating same.

21. Cleaning machine according to claim 12, in which an adjustable member coordinated with the valve control is arranged in the bottom outlet for passing liquid from the treatment chamber directly to the liquid-permeable compartment or, alternatively, through a strainer in the bottom outlet.

22. Cleaning machine according to claim 21, in which the strainer forms said adjustable member, the strainer being adjustable between an operative position wherein the strainer connects to the bottom of the treatment chamber to receive liquid flowing from the bottom, and an inoperative position in which the strainer is lifted from the bottom to leave a liquid passage between the lower side of the strainer and the bottom of the treatment chamber.

23. Cleaning machine according to claim 22, in which the strainer is covered by a cover defining a inlet opening to the strainer in relation to the bottom of the treatment chamber.

24. Cleaning machine according to claim 22 or 23, in which the strainer is pivotally mounted.

* * * * *